US006539887B1

(12) United States Patent
Vollmerhausen

(10) Patent No.: US 6,539,887 B1
(45) Date of Patent: Apr. 1, 2003

(54) BUS TO BOAT PASSENGER TRANSFER FACILITY

(76) Inventor: Robert H Vollmerhausen, 122 S. Van Buren St., Rockville, MD (US) 20850

( * ) Notice: Subject to any disclaimer, the term of this patent is extended or adjusted under 35 U.S.C. 154(b) by 11 days.

(21) Appl. No.: 09/798,853

(22) Filed: Mar. 1, 2001

Related U.S. Application Data

(63) Continuation-in-part of application No. 09/494,450, filed on Jan. 31, 2000, now abandoned.

(51) Int. Cl.[7] ..... B63B 35/44

(52) U.S. Cl. ..... 114/258; 114/230.1

(58) Field of Search ..... 114/230.1, 258, 114/45; 14/71.7

(56) References Cited

U.S. PATENT DOCUMENTS

| | | | | | |
|---|---|---|---|---|---|
| 2,836,293 | A | * | 12/1958 | Plumer | 114/44 |
| 3,707,934 | A | * | 1/1973 | Frankel | 114/258 |
| 3,736,898 | A | | 6/1973 | Yamura | 114/45 |
| 3,916,811 | A | | 11/1975 | Fromnick et al. | 114/125 |
| 3,931,778 | A | * | 1/1976 | Heijst | 114/258 |
| 5,016,309 | A | * | 5/1991 | Vollmerhausen | 14/71.7 |
| 5,016,551 | A | | 5/1991 | Peck et al. | 114/45 |
| 5,131,109 | A | | 7/1992 | Grip et al. | 114/45 |
| 5,215,024 | A | * | 6/1993 | McAllister | 114/45 |
| 5,623,889 | A | * | 4/1997 | Whitener | 114/258 |
| 6,073,571 | A | * | 6/2000 | Whitener | 114/230.1 |

* cited by examiner

*Primary Examiner*—Stephen Avila

(57) ABSTRACT

The invention is a integrated operation using buses to pick up passengers at outlying locations, transfer the passengers to a monorail system for ferrying the passengers to a floating dock structure where the passengers connect to a riverboat for using river-based transportation for communting.

8 Claims, 16 Drawing Sheets

Flg 2 (C)
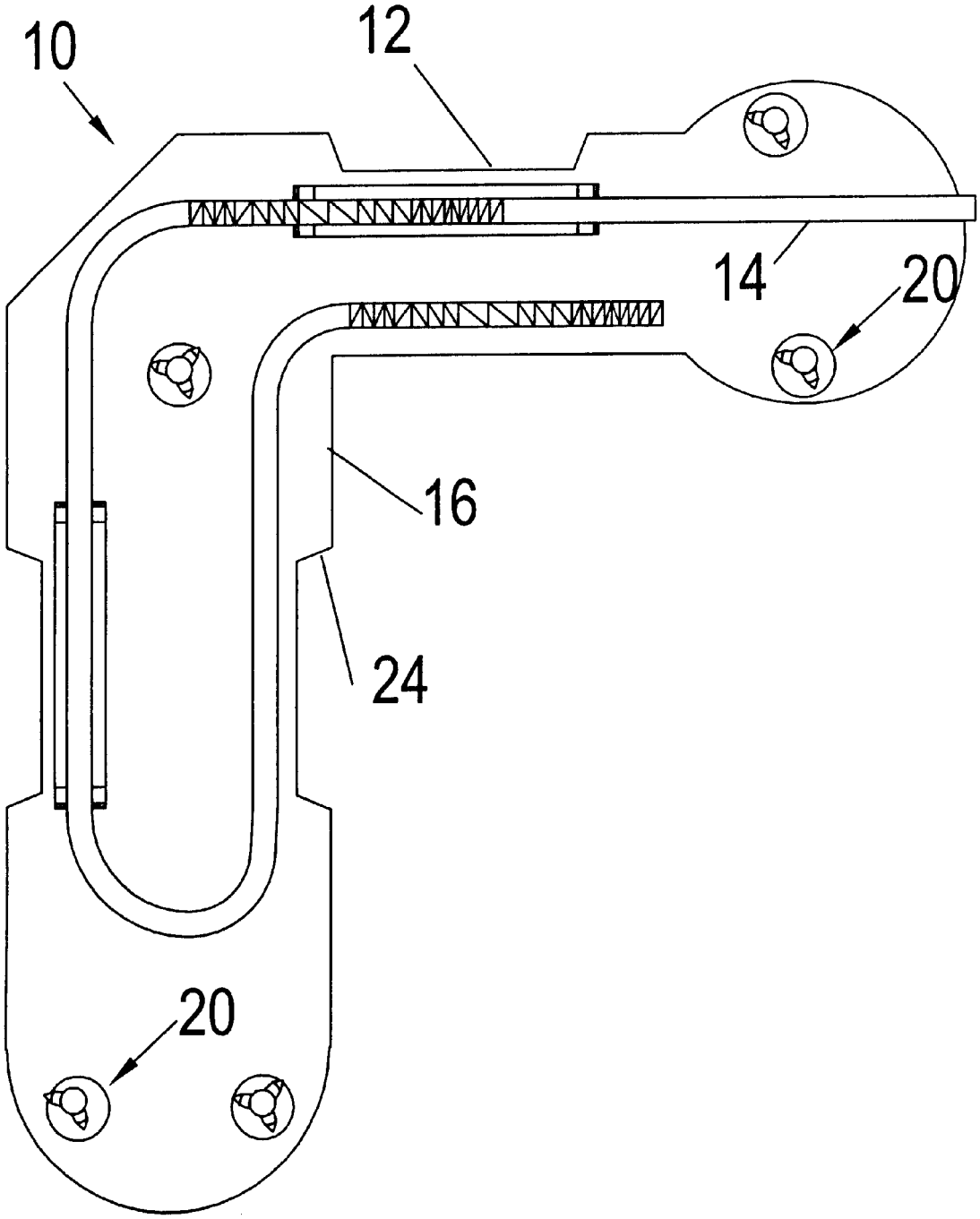

BUS TO BOAT PASSENGER TRANSFER FACILITY

This application is a Continuation-in-part of application Ser. No. 09/494,450, filed on Jan. 13, 2000 now abandoned.

BACKGROUND—FIELD OF INVENTION

This invention relates to a means for transferring passengers from buses to a waiting ship that is docked at a facility. The invention teaches the construction of a passenger transfer facility with the passenger transfer taking place in a manner that does not expose the commuting public to the risk of entering the water.

A parent application, filed Jan. 31, 2000, utilized a special marine terminal building to function as an 'interface mechanism' between the buses and a riverboat docked at the marine terminal. In that invention, the transfer procedure involved people leaving the buses and moving through the marine terminal, with safety barriers rising or lowering so as to protect the passengers from the risk of entering the water.

The present invention reduces that risk further by mechanically moving passengers from the buses directly down to the waiting riverboats; and, further the present invention is adaptable to a wide variety of geographic and topological conditions that make the potential use of the invention more likely.

The invention discloses a means for transferring passengers from buses, on the shore, to one or more riverboats waiting to receive the passengers. The invention includes a combination of buses, a transportation means for ferrying passengers from the buses to the waiting riverboats, and a means for establishing a substantially level plane between the riverboats, the transportation ferrying means, and a semi-floating dock structure.

BACKGROUND—DESCRIPTION OF THE PRIOR ART

| Inventor | Patent # | Description |
|---|---|---|
| Dr. AxeI L Wenner-Gren | (unknown) | Monrorail system. |
| Yamura | 3,736,898 | Device for controlling list and level of Pontoon. |
| Fromnick et al | 3,916,811 | Tide Compensation System |
| Frankel | 3,707,934 | Floating Stable Terminal |
| Peck et al | 5,016,551 | Lift for Water VehicIes |
| Grip el al. | 5,131,109 | Pontoon Bridge |

Yamura discloses a floating dry dock comprising a plurality of pontoons that are interconnected, means for leveling each pontoon. The means for leveling are two separate systems, one for leveling the list or inclination of the pontoons; and, a second system for controlling the depth of floatation.

Fromnick et al discloses a Tide Compensation System measures tide level with a float gauge to generate a digital signal. Another gauge is located in a ballast tank, in the floating structure. The two signals are compared, and the difference actuates valves to pump water into or out of the ballast tank, whereby the floating structure is raised or lowered in the water.

Frankel discloses a Floating Stable Terminal that is a floating island structure or deep water ship terminal, which can be anchored or free floating. The invention structure provides a safe berth for tankers, bulk carriers, or any type of ship. The terminal is also fittable with hydraulic or other effective fendering system assuring safe berthing of large ships alongside.

Peck el al. discloses a Left for Water Vehicles that is attached to one side of a dock structure. The Lift a air tank and surrounding structure so that a water vehicles can be raised above the water level, or lowered down to the water, by floatation or gravity.

Grip et al. discloses a Pontoon Bridge with Automatic Height Adjusting and Locking Systems that anchors a bridge to the bottom with weights. Cables are wound onto common shafts such that the winding up of sink cables causes unwinding of the anchor cables, which allows vertical adjustment of the bridge.

None of the prior art, taken singularly or collectively, disclose an apparatus for transferring passengers, from buses to ships, with the ships docked at a floating dock structure that uses a river's water flow to sequentially level each end of the float dock structure.

Further, none of the prior art discloses an apparatus for providing a means for coordinating a transfer of passengers from a passenger transfer means to and from a riverboat.

OBJECTS AND ADVANTAGES

Several objects and advantages of my invention are:

A primary object of this invention is to provide a means for vertical adjustment of a semi-floating passenger transfer facility so as to compensate for different water levels in an aquatic environment, such as a river.

Another object of this invention is to use the current flow of the aquatic environment, such as a rivers current, to assist in the facility leveling process so as to establish and maintain a substantially level orientation to a semi-floating platform.

Another object of the invention is to provide a means for establishing and maintaining sufficient freeboard so as to mechanically engage a docking riverboat in such a manner that water (wave flooding) does not enter the passenger compartment of either the riverboat or the passenger transfer means.

Another object of this invention is to provide a means for ferrying passengers from a bus location so as to establish a substantially level orientation between the means for ferrying passengers and the bus; and further, to establish a substantially level orientation between the means for ferrying passengers, and a riverboat docked at the passenger transfer facility so as to provide a safe, convenient, and weather-proof transfer of passengers to and from the means for ferrying passengers, and the docked riverboat.

A still further object of the invention is to provide a means for securing the riverboat to the transfer facility structure so as to establish a secure connection for the embarkation and debarkation of passengers.

A still further object of the invention is to provide a means for weather-protection as the passengers move from the passenger ferrying means to and from the buses and to and from the docked riverboat.

A still further object of the invention is to provide a passenger transfer facility that is adaptable to a wide range of aquatic and geographical conditions, from low riverbanks to high bluff conditions. By providing a passenger ferrying means adaptable to a wide range of installation conditions, the invention eliminates the need for elevators, escalators, or stairs.

A still further object of the invention is to increase the functionality of the passenger transfer facility by utilizing the riverboats themselves as secondary docking platforms whereby passengers move to and from the passenger ferrying means, through a riverboat and into another (the secondary) riverboat. More than one riverboat may dock at the same berth at the passenger transfer facility.

A still further object of the invention is to provide a means for wind abatement so as to minimize the wind-induced movement of riverboats at dock, or movements of the passenger transfer means.

Still further objects and advantages of the invention will become apparent from a consideration of the ensuing description and accompanying drawing.

BRIEF DESCRIPTION OF THE DRAWINGS

FIG. 2(A) is a top view of a verti-stop element that selectively engages the facility platform structure. FIG. 2(A) shows the verti-stop element(s) biased against the facility structure.

FIG. 2(B) is a top view showing the verti-stop element(s) disengaged (retracted) from the facility platform structure so that the platform structure will float to a establish a new waterline.

FIG. 2(C) is a top view of the passenger transfer facility illustrating the flow of river current against the structure such that, as one set of verti-stop elements engage the facility structure, another set of verti-stop elements disengages, freeing the structure to vertically adjust.

FIG. 2(D) is a top view showing a set of lateral locking guide elements and also showing a plurality of wind abatement elements disposed to the semi-floating dock structure.

FIG. 2(E) is a top view showing two riverboats dock together with a monorail gondola car disposed between the two riverboats.

PREFERRED EMBODIMENT—DESCRIPTION

Figure 1:
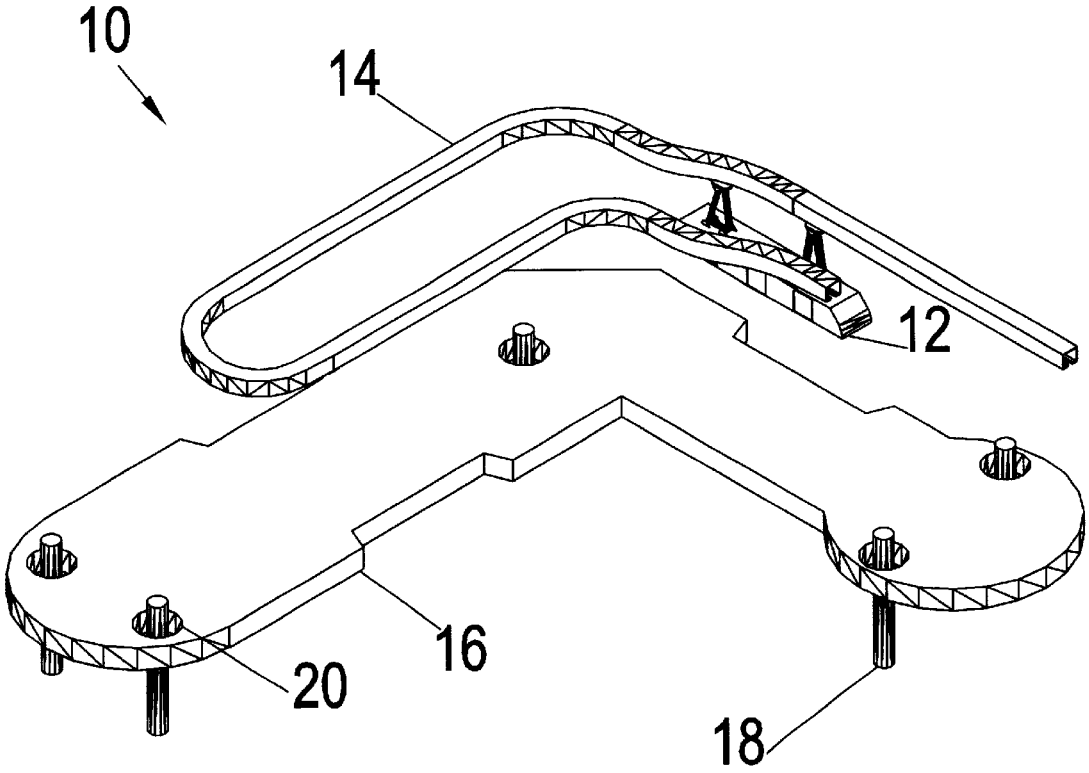
FIG. 1 is a perspective view of the passenger transfer facility that illustrates an elevated monorial disposed over a floating facility platform.
Figure 2:
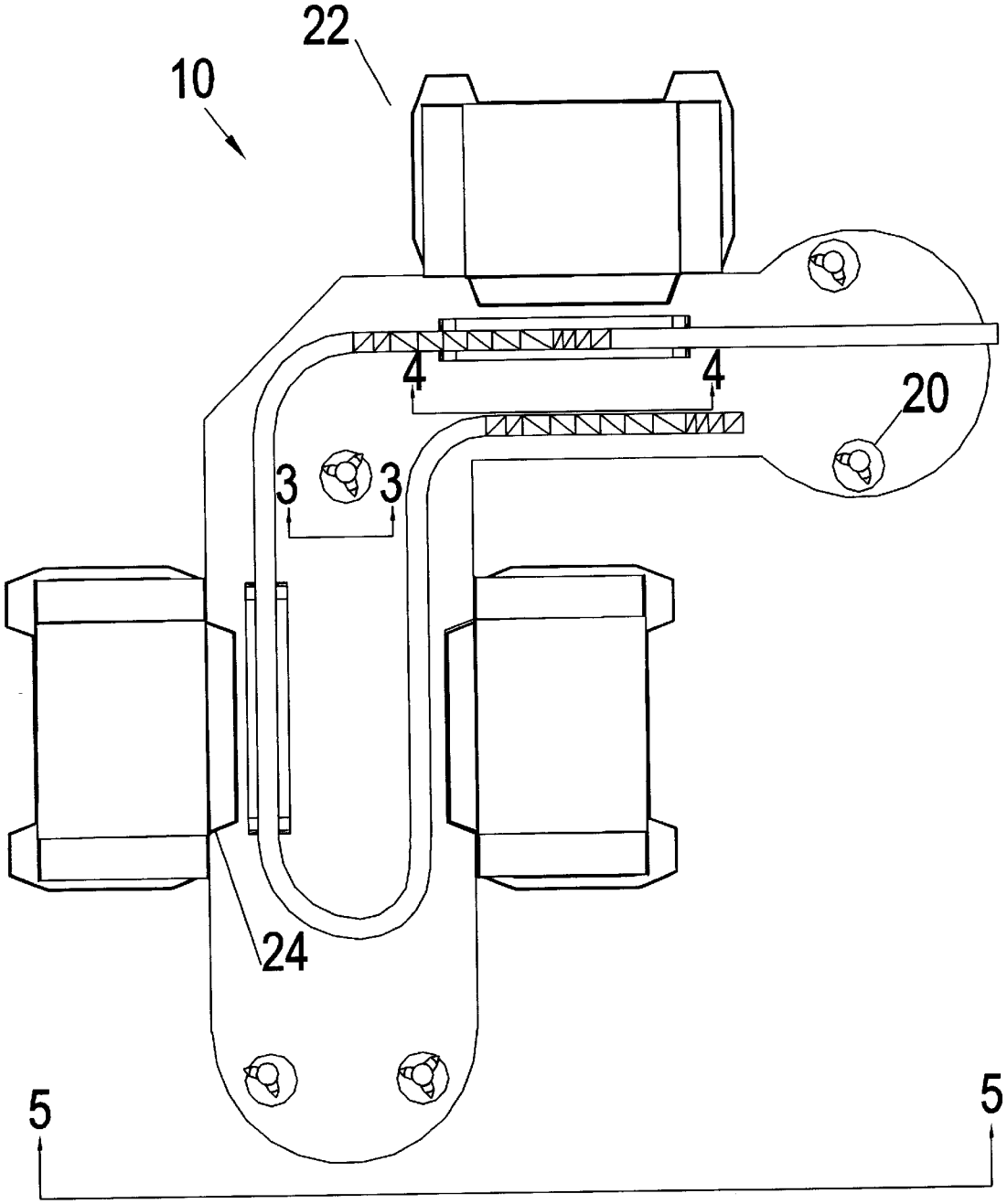
FIG. 2 is a top view of the passenger transfer facility showing both the monorail gondola cars disposed to an enclave element in the facility platform with riverboats docked within the enclave element.
Figure 2:
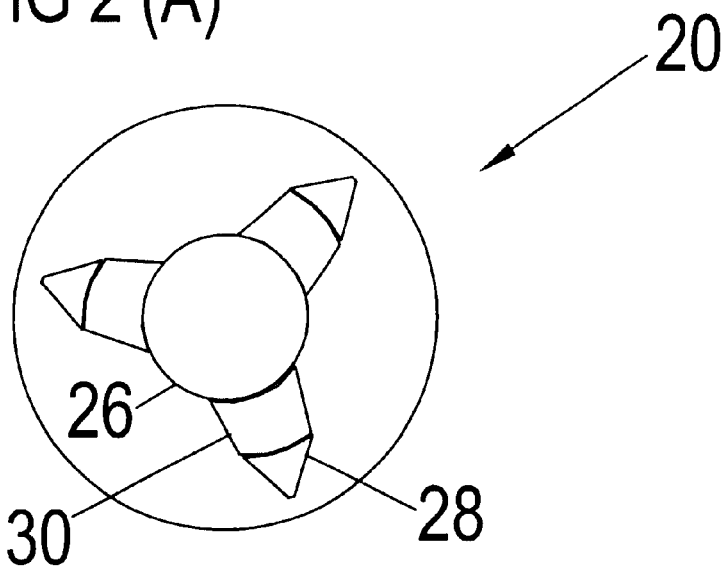
Figure 2:
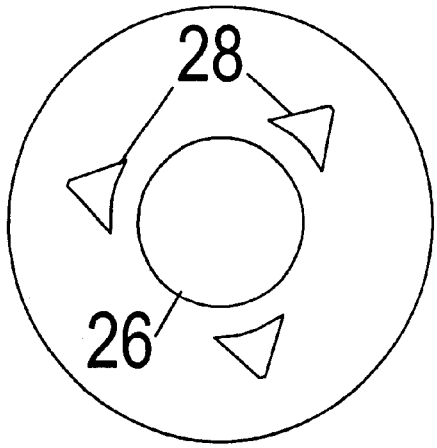
Figure 2:
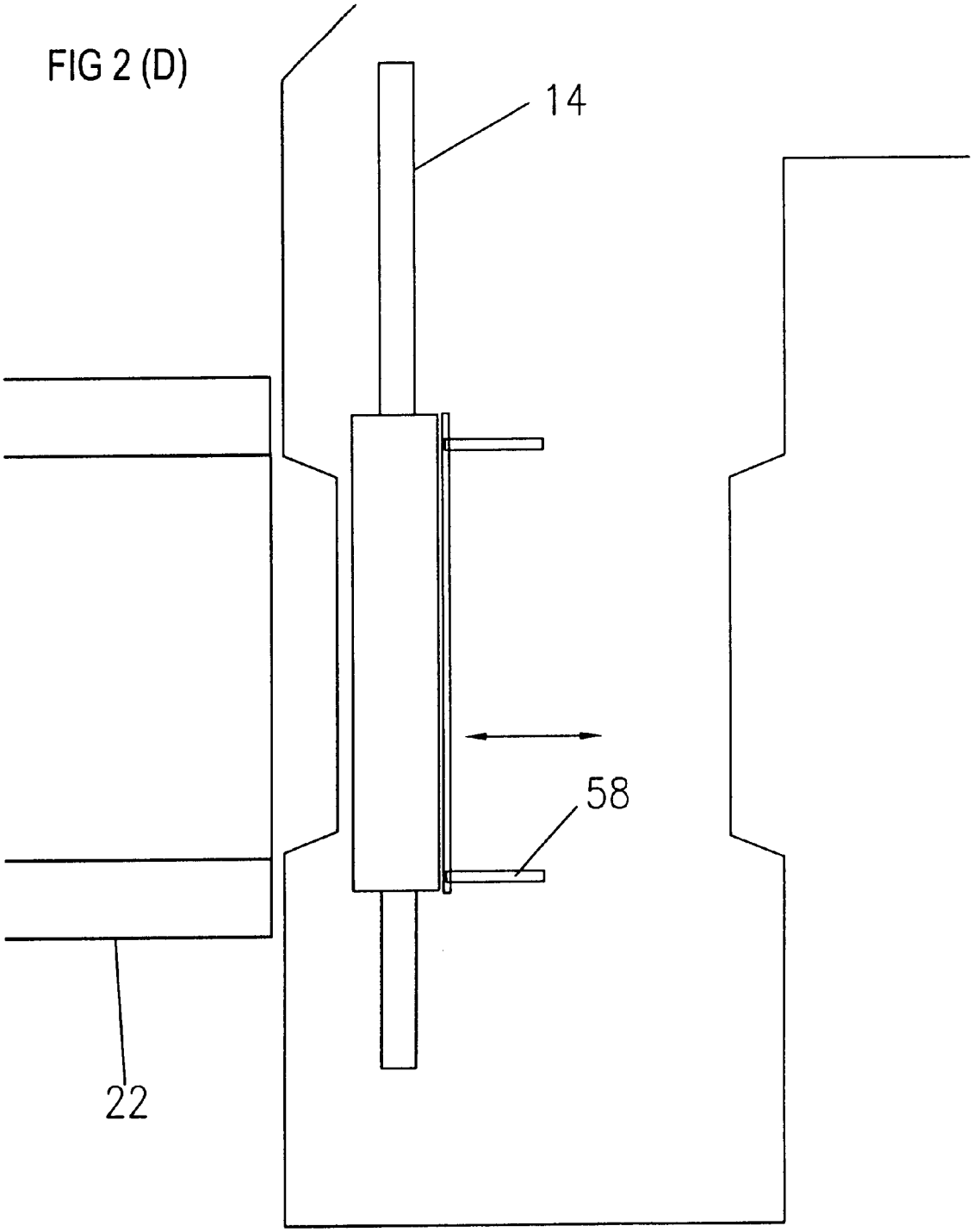
Figure 2:
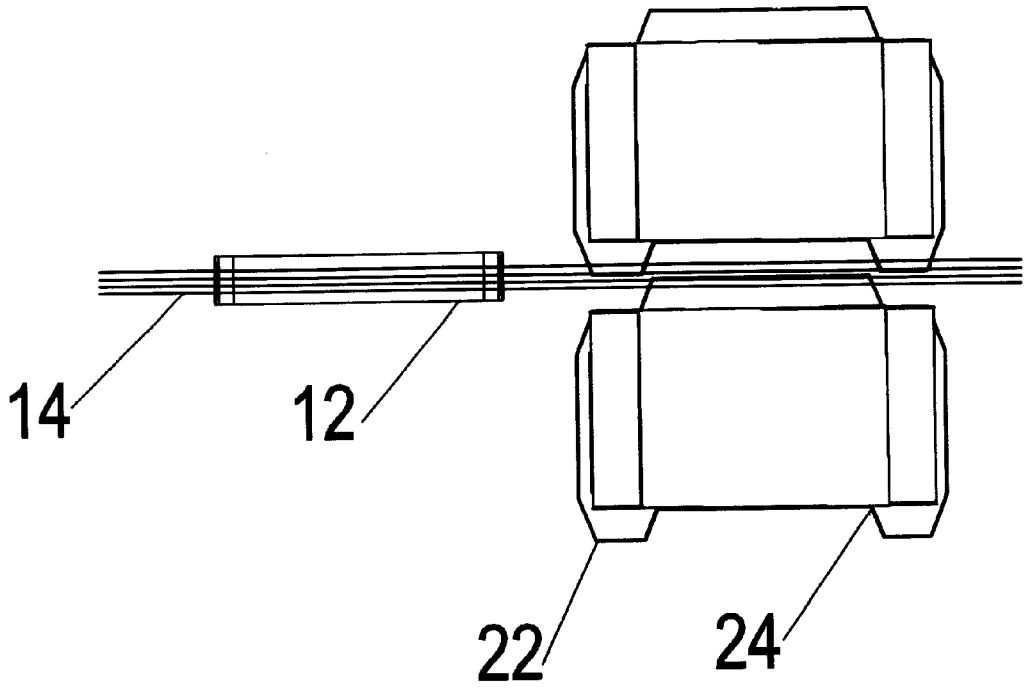
Figure 4:
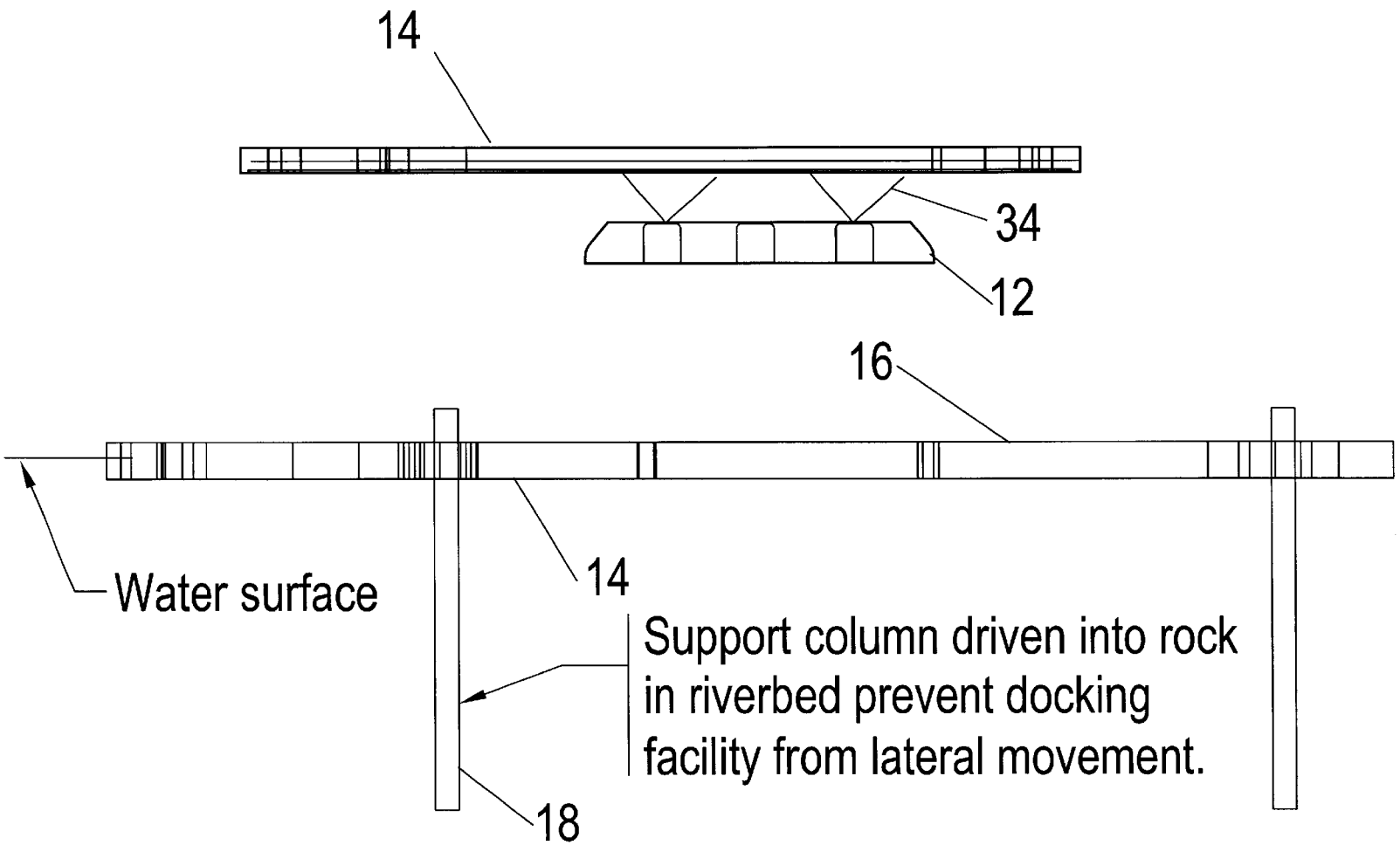
FIG. 4 is elevation view, taken along 4—4 of FIG. 2, of the passenger transfer facility that illustrates the overhead monorail, a gondola car depending downwardly on support cables, the facility platform structure and the facility support columns.

Referring now to the drawing in which like numerals represent like elements throughout, it will be apparent that the apparatus (10), a passenger transfer facility, consists of:

A means for ferrying passengers, such as an overhead monorail system (14) as shown best in FIGS. 1 and 4, including one or more elevated monorail tracks, each of which has one or more gondola cars (12) depending downwardly from the monorail track, a semi-floating docking structure (16) with a plurality of enclave docking elements (24) so as to mate with at least one riverboat member (22), as shown best in FIG. 2, a means for leveling the semi-floating docking structure (16), such as a plurality of verti-stop elements (20), as shown best in FIG. 2.

Figure 5:
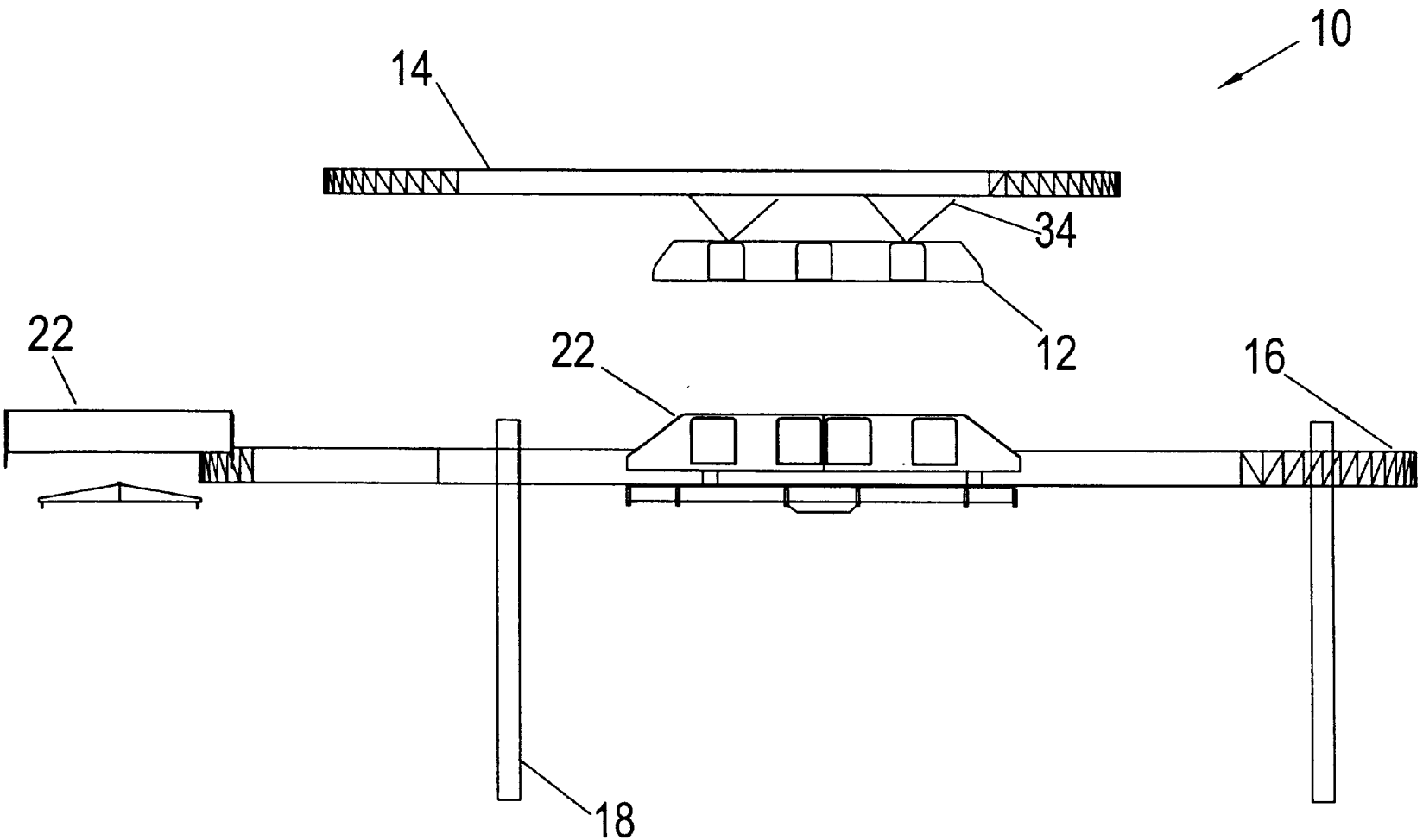
FIG. 5 is a an elevation view, taken along 5—5 of FIG. 2, showing a plurality of riverboats docked at the passenger transfer facility, an overhead gondola car positioned so as to lower to within access distance of the riverboat.

The means for ferrying passengers (12/14), the simi-floating dock structure (16) and the means for leveling work cooperatively to achieve the objects of the invention, the mechanism and elements of which are further explained and claimed hereinafter. As will be seen from the drawing, the means for ferrying passengers (14) is disposed substantially over the semi-floating dock structure (16) so as to position the gondola cars (12) adjacent to a docked riverboat (22) as the gonidola car (12) is lowered on cable assemby (34) as shown best in FIGS. 4 and 5.

Figure 3:
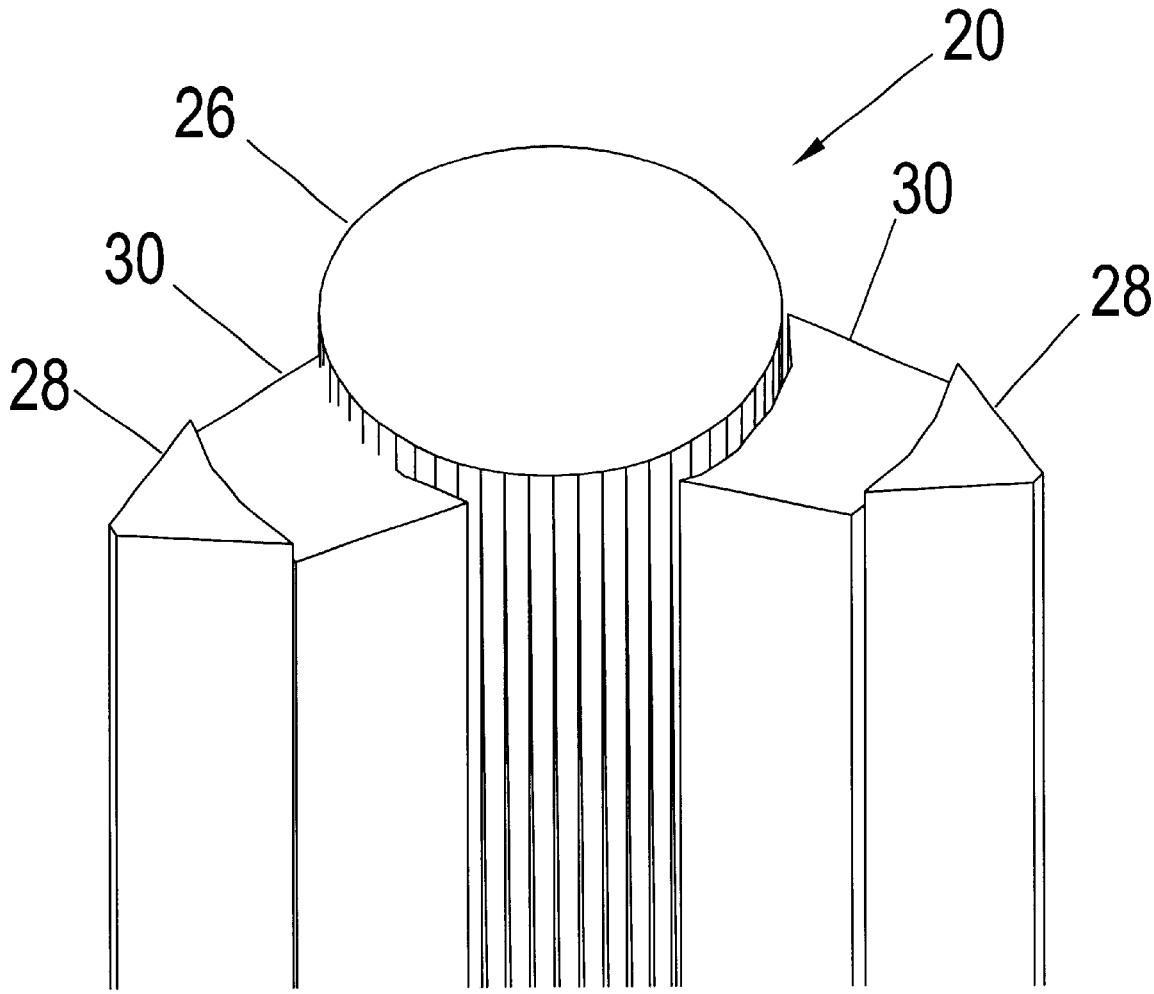
FIG. 3 is a perspective view, looking at direction 3—3 of FIG. 2, of the verti-stop elements showing a central support column, an inflatable member, and the verti-stop elements that is actuated to bias against the interior walls of the facility platform structure.

The semi-floating dock structure (16) is held in horizontal position by a plurality of support columns (18/26) with the upper reaches of the support column (26) structurally supporting inflatable element (30) and verti-stop element (28) as best shown in FIGS. 2(*a*), 2(B) and FIG. 3. The lower reaches of support column (18) is anchored in riverbed rock so as to prevent the semi-floating dock structure (16) from lateral movement.

As the river water level rises and falls with the tides and rain runfoff, the semi-floating dock structure (16) must raise or lower to maintain freeboard for docking of riverboats. A means for leveling, such as the plurality of verti-stop elements (28) are disposed in a circular array around each of the support columns (18/26) as each one of the support columns (18/26) protrudes upwardly through holes (not numbered) in the semi-floating dock structure(16) as shown best in FIG. 1.

As shown best in FIGS. 2(A) and 2(B) the verti-stop elements (28) extend outwardly so as to bias against an interior wall surface of the semi-floating dock structure (16). As the verti-stop elements extend outwardly, biasing against the interior wall surface, the floating dock structure (16) is held against vertical movement. Conversely, as the verti-stop elements are retracted, due to collapsing of the inflatable member (30), the verti-stop elements retract, pulling away from the interior wall surface. applied and lifted off of the semi-floating dock structure would require that the supporting beams be much heavier and thus increasing the cost of the installation. As the support structure (not shown, not numbered) for the monorail system must already be designed to accomodate the weight of the gondola cars there is no reason to add to the weight or cost of the semi-floating dock structure or it's support columns.

As each one of the gondola cars is lowered into a position adjacent to a riverboat (22), the gondola car (12) descends downwardly into a set of lateral locking guide elements (58), as shown best in FIG. 2(C). The lateral locking guide elements, when actuated, bias agianst a lower portion of the gondola car to position the car and to stabilize the gondola car against wind acting against the exposed sides of the gondola car.

Figure 11A:
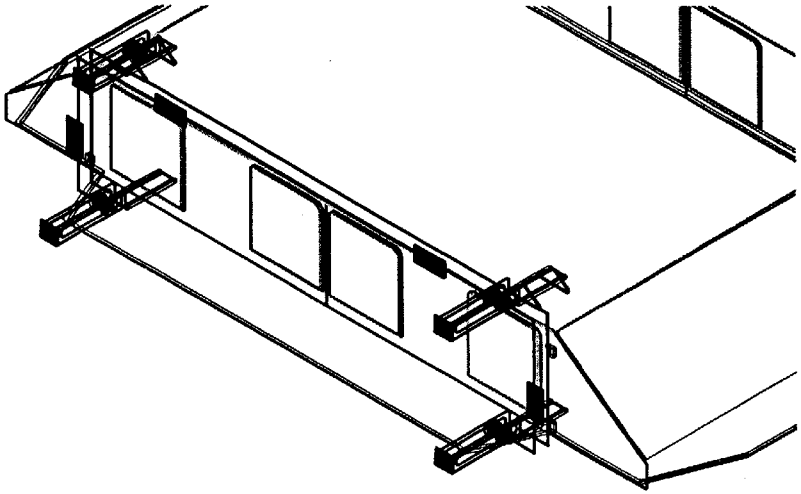
FIG. 11(A) is a perspective view of a ship-mounted flexible enclosure member.
Figure 11B:
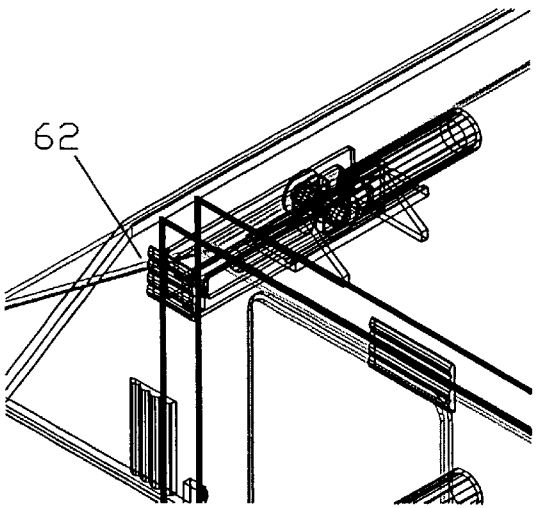
FIG. 11(B) is a perspective view of the means for shelter in a retracted position.
Figure 11C:
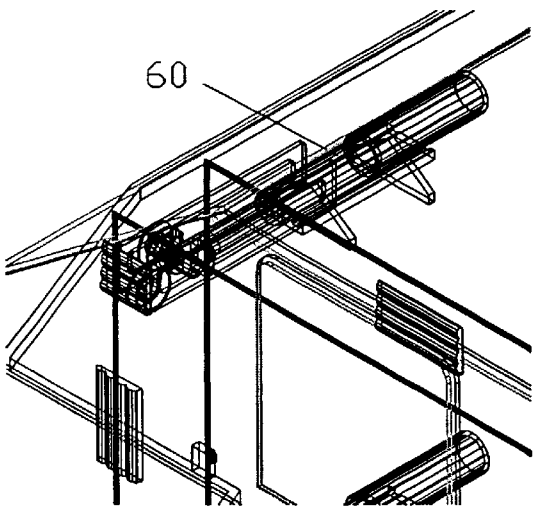
FIG. 11(C) is a is a perspective view of the means for shelter extended outward to bias again the walls of a gondola car.

The 'outboard' lateral locking guide elements (closest to the riverboat) are locked into place, while the 'interior' lateral locking guide element(s) is hydraulically actuated, on a hydraulic arm, similiar to that shown in FIGS. 11(A, B and C) so as to bias against a gondola car that is in position, adjacent to a riverboat. Both a means for shelter (60) and the lateral locking guide elements (58) function to control the wind-induced movement of a gondola car (12) in position for the transfering of passengers.

FIG. 2(D) illustrates a gondola car disposed within the lateral locking guide members and also illustrates a plurality of wind abatement elements (not numbered) positioned in and around the perimeter of the semi-floating dock structure (16) so as to moderate the effects of wind on the gondola car as it travels below the monorail track.

The means for leveling moderates the forces of both wind and water on the semi-floating dock structure. The means for leveling uses the pressure exerted on the semi-floating dock structure (the platform itself by the river flow, the river's current.

FIG. 2(C) is a top view of the passenger transfer facility that also shows a direction for the river current. As the river flows past the facility, water pressure pushes against the semi-floating dock structure. While the support columns (18126) do not move, the semi-floating dock structure (the platform itself is biased against at least one verti-stop element that is oriented up-river; that is, a verti-stop element (28) in the path of the semi-floating dock structure (the platform) has it moves with the current, bumping against the verti-stop element.

Through the selective actuation of the inflatable member, the up-river side of the semi-floating structure can be mechanically constrained (stopped from moving vertically) while the down-river verti-stop elements are retracted. This process mechanically frees the down-river part of the floating dock structure (16) to float to a new waterline, while concurrently maintaining the overall semi-floating dock structure (16) in place, laterally. The sequence of actuation is then reversed, to float the floating dock structure to a new waterline in the up-river direction. In this sequence, of actuating up-river and then down-river verti-stop elements, the semi-floating dock structure uses the force of river water flowing past the structure to re-floating the semi-floating dock structure to a new waterline, while at the same time, preventing lateral movement of the floating dock structure.

The inflatable member can be any suitable technology for pumping air or hydraulic fluid into an inflable bladder element (30) so as to extend or retract the verti-stop elements. As the verti-stop elements are biased against the semi-floating dock structure, the semi-floating dock structure is mechanically constrained from vertical movement; that is even if there were a nominal change in the bouyancy, the biasing of the verti-stop elements prevents vertical movement of the semi-floating dock structure.

Each one of the verti-stop elements is individually actuated so as to bias against the floating dock structure (16). In this manner any part of the semi-floating dock structure is raised to a new waterline, while preventing a 'seesaw' motion of submerging another part of the floating dock structure. Without the positive control of the verti-stop elements one part of the semi-floating dock structure could, under the force of wind and waves, float up in a manner that would force the opposite end of the semi-floating dock structure to displace downwardly, into the water.

By "locking" one end of the semi-floating dock structure (16) as the other end floats to a new waterline, the means for leveling (20), provides a mechanically positive means for controlling the lateral movement of the semi-floating dock structure, while concurrently freeing the semi-floating dock structure to reestablish freeboard as river condition change. Dock structure (16) is a semi-floating structure, because while most of its weight is displaced in water, by floatation tanks (not shown) the dock structure is 'held' against the upward pressure of water, or the downward pressure of live loads that may be placed on it, by the combined force of the verti-stop elements biasing against the semi-floating dock structure (16).

The semi-floating dock structure (16) is held vertically in position by actuating the verti-stop elements as long as a transfer of passengers in taking place between the means for ferrying passengers and the riverboats different transportation modes. As river conditions warrent, and as the control system actuates the means for leveling, the semi-floating dock structure (16) is sequenced to a new vertical gradient that positions the semi-floating dock structure (16) within a vertical range to re-start the docking of riverboats, and the transfer of passengers.

Just as the semi-floating dock structure must readjust to comform to river conditions, so each of the riverboats must also have the functionality to move a passenger compartment up or down to dock correctly with the semi-floating dock structure.

Mechanically re-establishing a new waterline is essential for docking riverboats, that displace their weight substantially level in the water, bow to stern. Positive leveling of the semi-floating dock structure (16) provides a secure mechanical mating of the riverboat and the floating dock structure (16).

Figure 7:
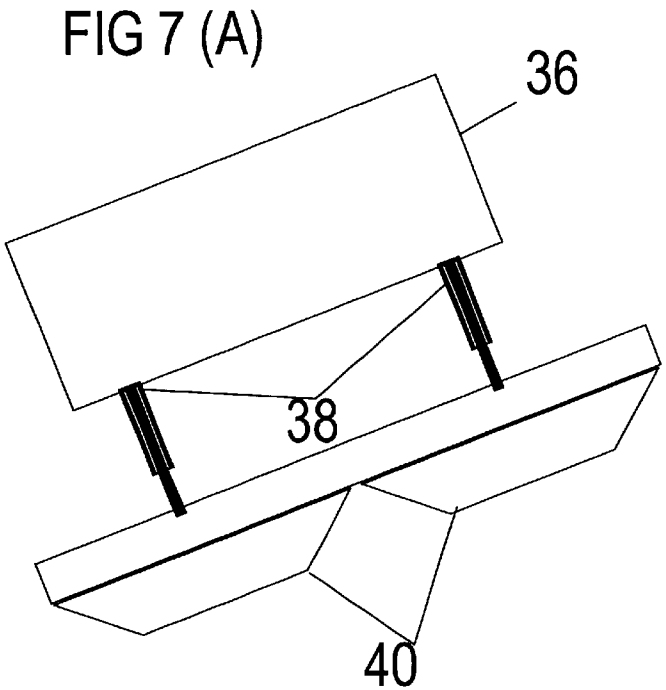
FIG. 7(A) is an enlarged view of a clamping member for biasing the riverboat against the passenger transfer facility platform structure.
FIG. 7(B) is a view showing a enclave element in the passenger transfer platform and a riverboat with a convex centermount element for docking within the enclose element.
Figure 7:
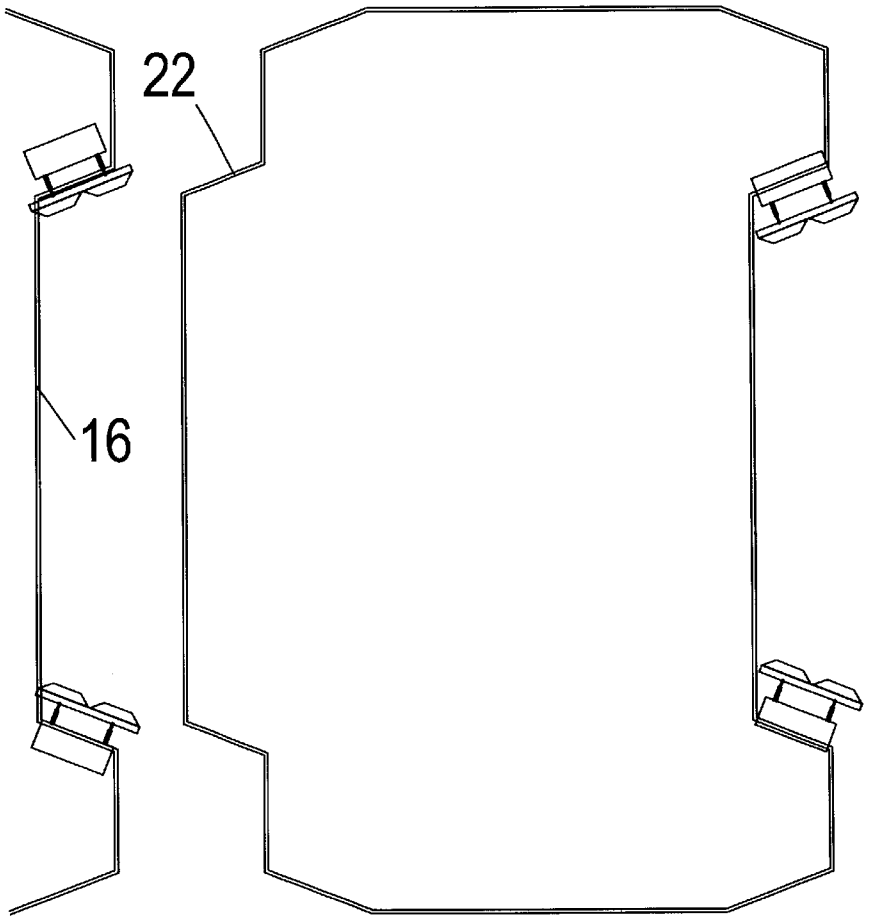

FIGS. 7(A) and 7(B) show the docking mechanism in greater detail. Riverboat (22) is asymetrical in plan view, with convex and concave design elements (not numbered) so as to mate with the semi-floating dock structure (16). At least two clamping mechanisms (36/38/40) as shown best in figure (7(A) are disposed to the lateral reaches of the semi-floating dock structure enclave (24) so as to extend hydraulic pistons (38) that bias bumper elements (40) against the outer reaches of the riverboat mating element (not numbered).

FIG. 2 illustrates riverboats docked at the floating dock structure (16) with two riverboats docked, concurrently, side by side, at the same docking enclave (24).The same clamping mechanism (36/38/40) locks the two riverboats together as is used to lock the primary riverboat to the semi-floating dock structure (16).

Passengers move between the two (primary and secondary) riverboats sheltered from sun, wind and rain, by a means for passenger shelter. The means for passenger shelter is a mechanism used between the riverboats and the 'parked' gondola car (12) as it is lowered to leave off on take on passengers. A gondola car (12) disposed between a primary and a secondary riverboat is shown in FIG. 2(E).

FIGS. 11(A and B and C) illustrate a means for shelter, such as flexible member (not shown, not numbered) supported on a hydraulically acutated framework (60). Framework (60) is hydraulically extended, to dispose the flexible member outwardly prior to the doors of the riverboats or the doors of the gondola cars (12) opening.

The means for shelter functions in a manner similiar to the lateral locking guide elements (58) in that, as a gondola car is disposed between a primary riverboat and a secondary riverboat, docked together, the actuated means for shelter biases a plurality of pliable bumper elements (62), as shown in FIGS. 11(B and C). The means for shelter minimizes wind-induced movement of the gondola car that is substantially suspended from the cable assembly.

Figure 9:
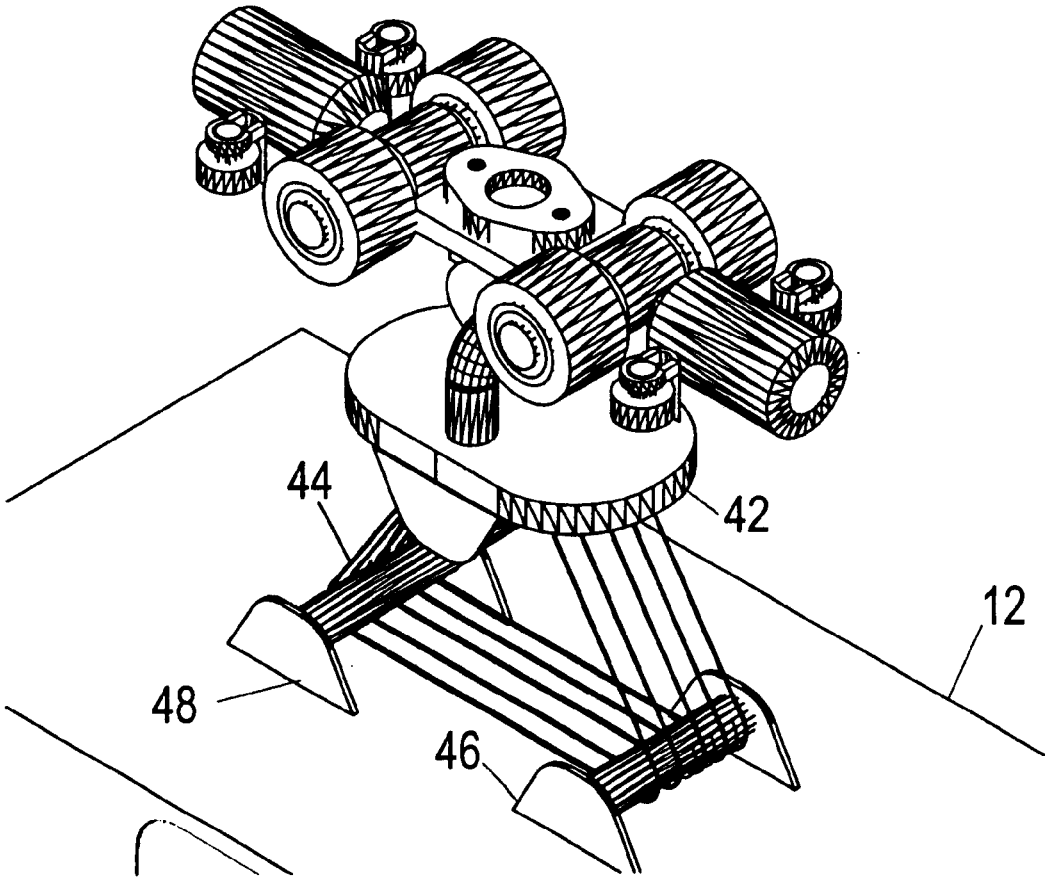
FIG. 9 is a perspective view of the gondola car cable assembly.

In the preferred embodiment, the cable assembly is a plurality of high strength cables wound over wind-out and wind-up spools that are motor driven through a gearbox as shown in FIG. 9.

Each one of the gondola cars (12), depending downwardly from track (14) must maintain a level orientation, in transit, as the track curves upward or downward in a vertical arc. Cable assembly (42/44/46/48) plays out cable, as shown best in FIG. 4, so as to keep the gondola car (12) level even as the track (14) inclines upwardly or downwardly. FIG. 9(A) is a perspective view of the cable assembly.

Element (42) is a support member for the cable assembly. Element (44) is a cable takeup roller to feed cable to a takeup reel, above. Element (46) is a play-out reel that feeds cable below the assembly, to the takeup reel. Cable is unspun from a storage reels above (not numbered). Each gondola car (12) has at least two cable assemblies, each independently controllable, so as to keep the gondola car (12) level as it traverses the track circuit. The gondola cars (12) ferry passengers from buses (or lightrail metro rail cars) to the riverboats, and maintain a level orientation transversing downwardly from the passenger embarkation area to the semi-floating dock structure (16).

Figure 6:
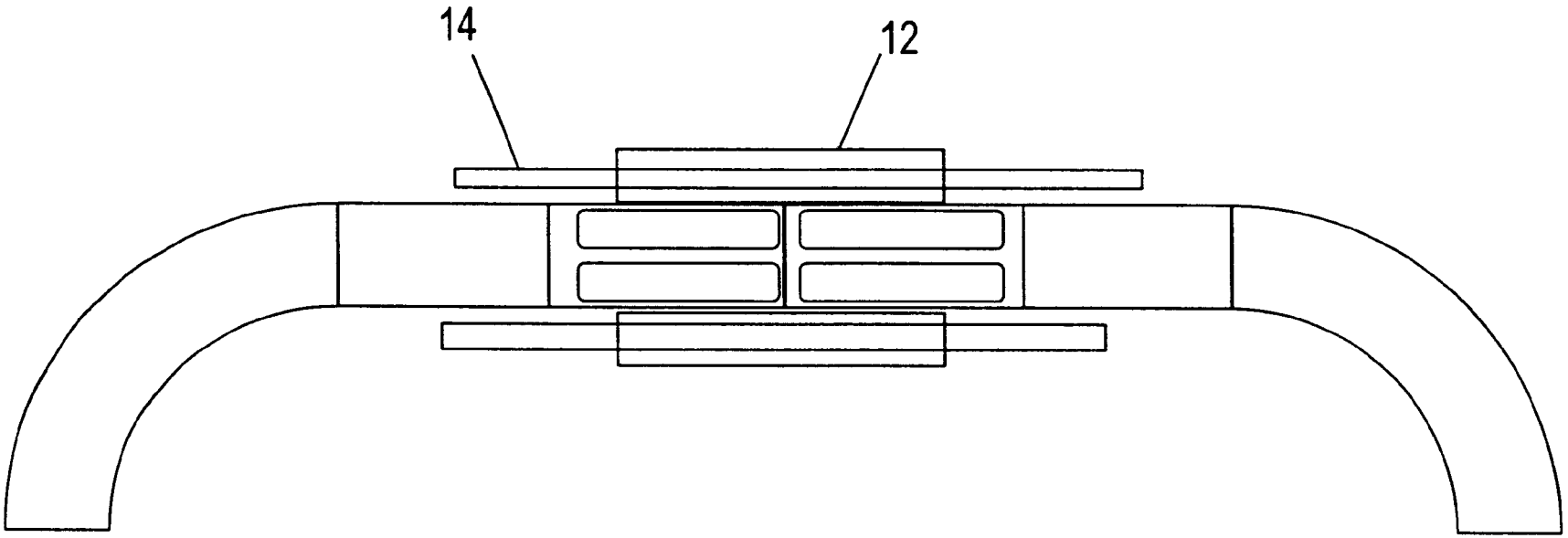
FIG. 6 is a top view showing the monorail system linking to buses that travel in and out of the onshore facility.
Figure 10:
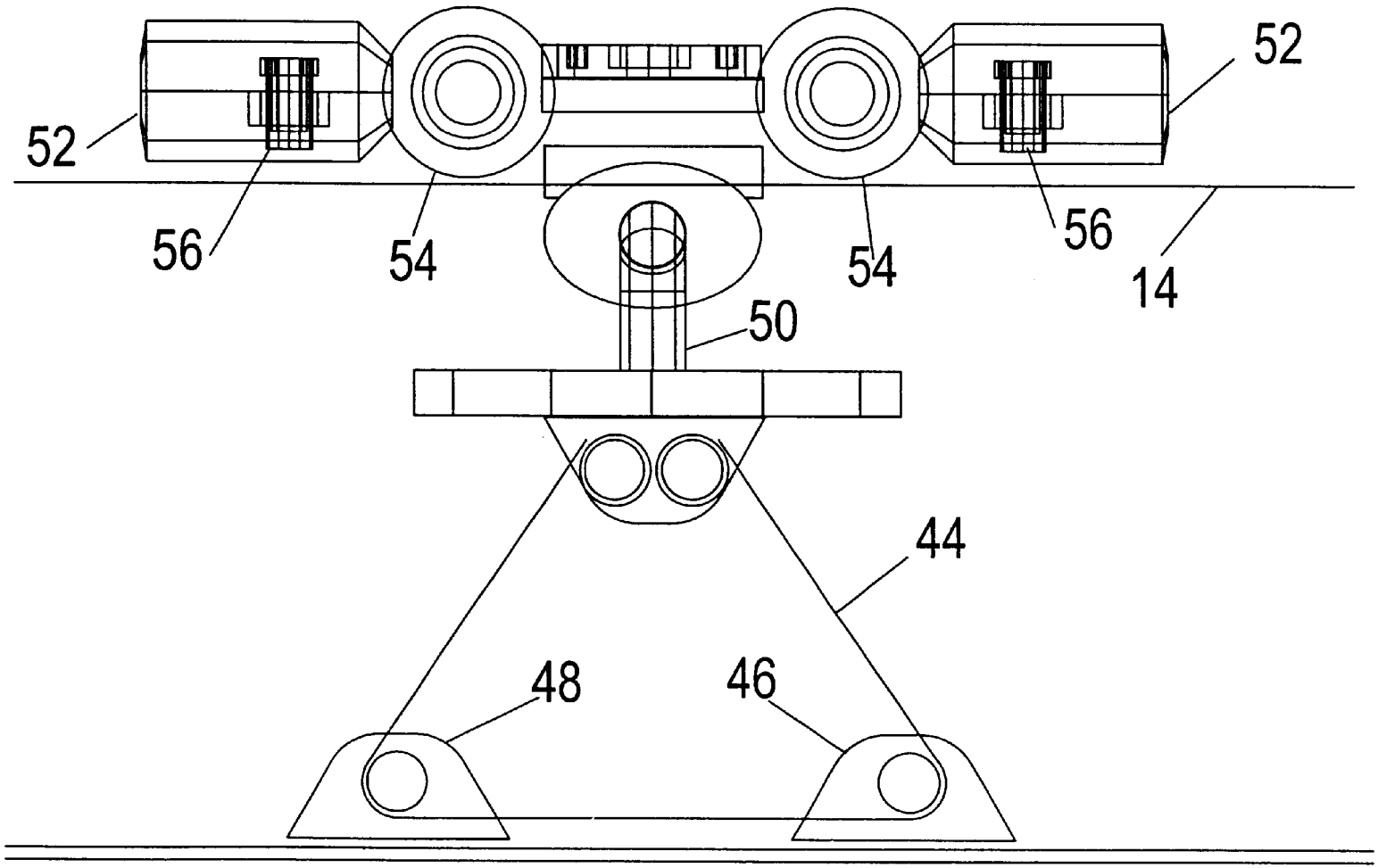
FIG. 10(A) is a elevation view (through the overhead track) of the drive wheel mechanism.
FIG. 10(B) is a top view of the monorail drive mechanism.
Figure 10:
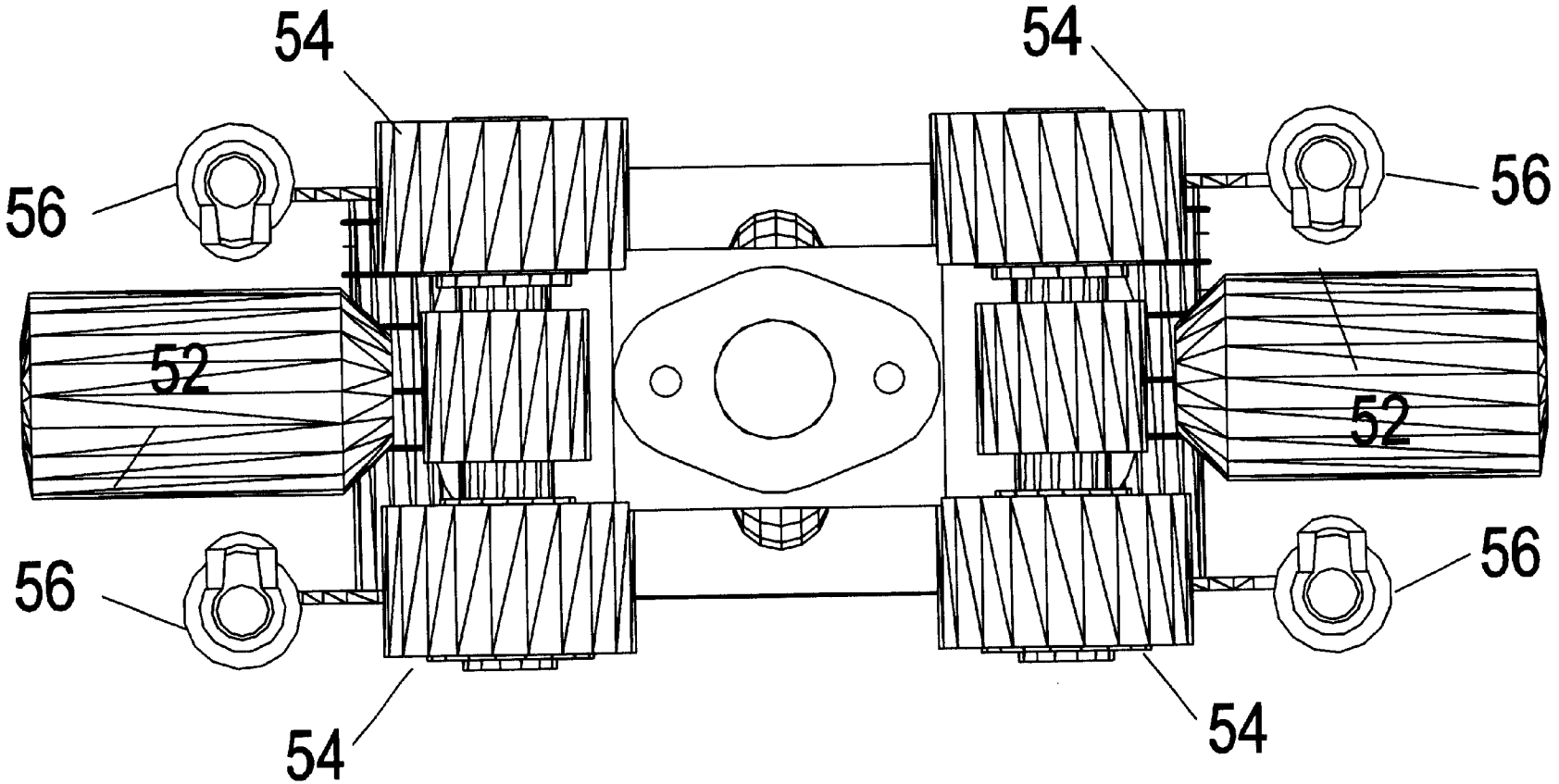

FIGS. 6 and 10(A) and 10(B) show more detail of the track/gondola car assembly, the drive mechanisms (for reference only) and a typical road/track layout of the gondola cars (12) taking on and leaving off passengers with parked buses. FIG. 6 illustrates a road layout installation showing the buses driving up a ramp to meet with the gondola cars (12) and then decending and exiting the installation by way of a curved roadway.

Gondola cars (12) are suspended downwardly from pivot assembly 50, as shown best in FIGS. 10(A) and 10(B). Electric motors (52) drive mainwheels (54). Guidewheels (56) steer each of the drive units within the track.

Actuation of the means for leveling prevents the semi-floating dock structure from 'heaving' in waves and wind; and further, prevents the semi-floating dock structure from moving upward (or downward) in a vertical direction (perpendular to the plane of the semi-floating dock structure) as the means for ferrying passengers is in operation.

In the preferred embodiment, the means for ferrying passengers is a monorail system with an elevated track and a plurality of gondola cars depending downwardly from the monrorial track. Each of the gondola car descends from the overhead track down to a vertical gradient substantially level with the doors of a riverboat docked in the semi-floating dock structure(16).

The weight of the gondola car does not rest on the semi-floating dock structure, but is suspended on the gondola car cable assembly. The gondola car(s) keep their weight on the gondola car cable assembly, because in some applications the semi-floating dock structure is comparatively small, while the gondola car could, at least in theory, be quite heavy, weighing fifty tons or more.

The Passenger Transfer Facility maintains a substantially level orientation; and, as each riverboat docking with the Transfer Facility has a riverboat means for leveling, each riverboat is disposed substantially level in the water. All three major components of the Passenger Transfer Facility, then, maintain an operational level orientation so that passengers have a substantially flat, level flooring between a gondola car and a riverboat, with the riverboat docked to the semi-floating dock structure to prevent lateral movement of the riverboat due to wind or current.

PREFERRED EMBODIMENT—OPERATION

Figure 8:
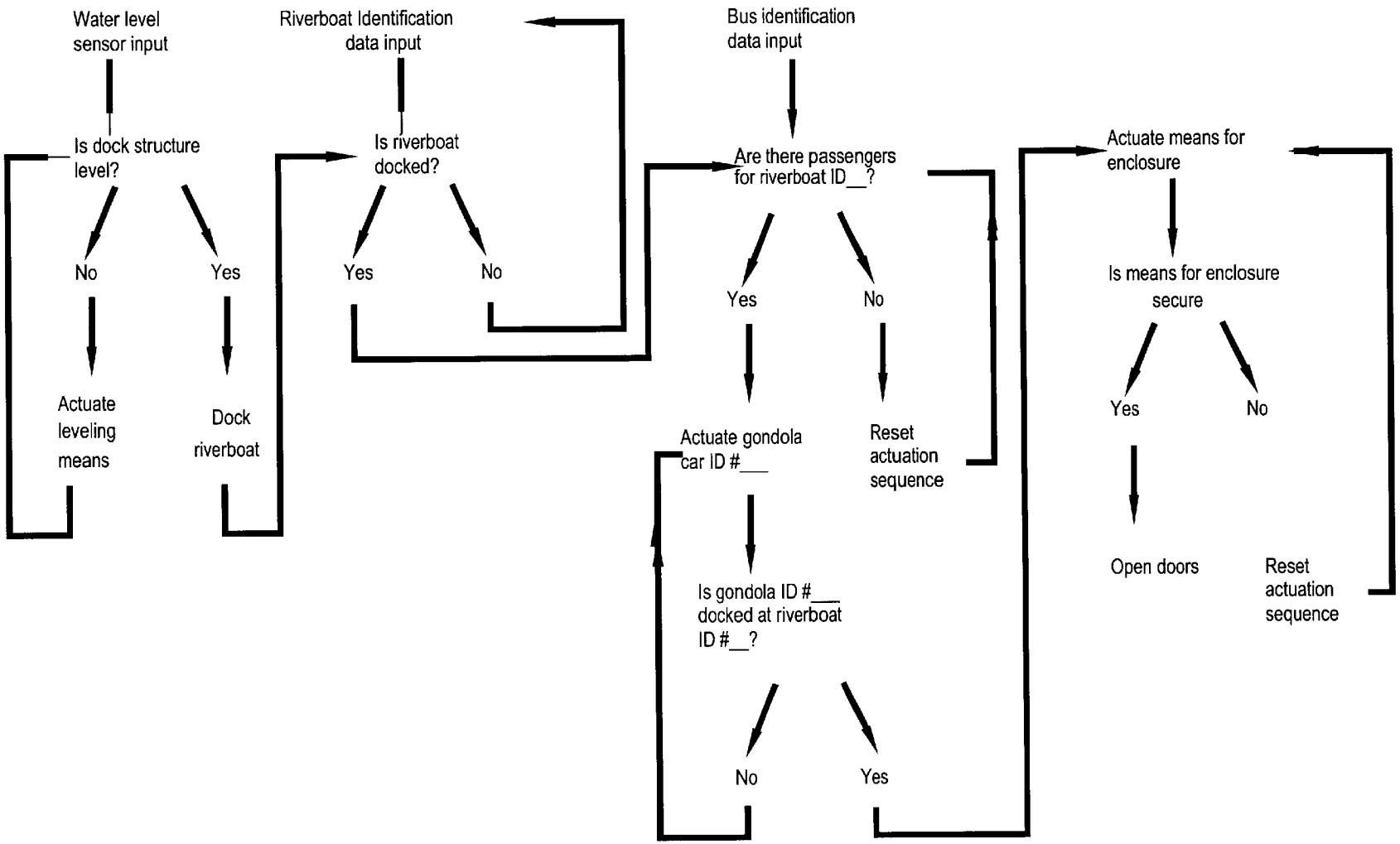
FIG. 8 is a control schematic

FIG. 8 is a control schematic. As pianos have keyboards so any modern transportation system has a control network; and, the fundamental control program to this invention is that of sequencing each operational step, before actuating the next step in the process.

From the time that each identified bus enters the facility, the bus doors and the movement of the bus itself is under positive system control. As shown in FIG. 8 data enters the control network indicating what buses are in the load/unload ramping area, what riverboats have docked, and which gondola cars are taking on passengers from the buses and which are transferring passengers to the riverboats. As shown in FIG. 8 this pairing of system resources, buses, gondola cars, and riverboats, is done by assigning unique identification numbers to each resource and then tracking the location and movement of those resources.

As each transportation resource moves into position, and as its location is monitored in the network control system, another control sequence is actuated to ensure that a riverboat is waiting, is docked, and is secure, before actuating the passenger shelter means. Only after the system registers that the gondola car is in position, and that a riverboat is docked, and that the passenger shelter means is actuated, can the doors open.

Passengers do not directly step into or onto the semi-floating dock structure (16). Passengers move only directly between one form of transportation and another. Passenger movement is controlled by the safety control sequence so that there is a correct matching between bus, gondola car, and riverboat. Buses pulling into the ramp area are met by gondola cars, whose movement on the track matches the destinations of the buses with those of the riverboats. The same process is reversed at the other end of the trip.

The gondola cars function not only to provide a means for ferrying passengers from the buses to the docked riverboats, but also provide a method for passengers to transfer between one route and another. More than one gondola may stop at a bus parked on the ramp area. Passengers enter and exit the bus, catching a gondola linking them with a riverboat, and a destination, desired. This process of passengers selecting which transportation resource to take continues as the gondola car positions itself on the floating dock structure, next to a riverboat.

Passengers have a choice of what bus to take. Also, as each gondola may stop, and position itself, at a plurality of riverboats, passengers need to be aware of when to exit the gondola car; and further, more than one riverboat can dock at the passenger transfer facility. So passengers may have to exit the gondola car, travel through the first riverboat and into the second in order to reach the correct riverboat.

Every transportation system requires a way for commuters to select one route over another. A 'blue line' or a 'red line,' as with the Washington, D.C. area light metrorail system. The Passenger Transfer Facility provides the commuter with choices in which bus to take at a local neighborhood pickup location, which gondola car to take at the bus/gondola car site; and, which riverboat to take, and finally, whether or not to move through a riverboat to access another riverboat docked alongside. The Passenger Transfer Facility provides commuters with a way to select a wide variety of destinations.

The elements of the invention cooperate to provide a Passenger Transfer Facility that is adaptable to wide variations in topological and geographic conditions as the monorail can be designed to carry passengers even over steep grades as the cable assembly maintains a level orientation to the gondola car(s).

CONCLUSIONS, RAMIFICATIONS, AND SCOPE

Accordingly, it can be seen that the combination of elements, the buses, the means for ferrying passengers, the semi-floating dock structure, with docking enclaves, and the riverboats, all work cooperatively to achieve the objects and advantages of the invention.

Although the description above contains many specificities, these should not be construed as limiting the scope of the invention, but as merely providing illustrations of some of the presently preferred embodiments of this invention. Various other embodiments and ramifications are possible within it's scope. For example, A combination monorail/elevator mechanism could be built to ferry passengers directly out of waterside office buildings, down to the passenger transfer facility. In that arrangement, the commuters would not even have to go to street level, or even necessarily take an elevator to the ground floor.

This invention has wide potential application in urban design, commuter traffic system design, and could for example, be part of a comprehensive urban/traffic plan for improving the traffic flow around airports. Some airports, such as Boston Logan Airport are located near water and that might lend these airports to consider using a mix of transportation forms to better serve the commuting public.

What is claimed is:

1. A Passenger Transfer Facility apparatus, comprising:

a means for ferrying passengers, a semi-floating dock structure, said semi-floating dock structure including a means for leveling, said semi-floating dock structure including at least one set of lateral locking guide means for receiving said means for ferrying passengers, said semi-floating dock structure including at least one enclave docking element, each one of said enclave docking elements disposed to receive a centermount element, a clamping means, said clamping means disposed to the outer reaches of each one of said enclave docking elements, at least one riverboat, each one of said riverboats including at least one centermount element, said means for ferrying passengers includes a means for leveling said means for ferrying passengers whereby, as said means for ferrying passengers is leveled with said semi-floating dock structure, as said set of lateral guide means for receiving said means for ferrying passengers is actuated; and, as each one of said riverboats centermount elements mate within an enclave docking element of said semi-floating dock structure, passengers are transferred between said passenger ferrying means and said riverboats.

2. A Passenger Transfer Facility apparatus as recited in claim 1 wherein said means for ferrying passengers consists of an overhead elevated monorail track and a plurality of gondola cars equipped to travel on said monorail track, said monorail track is disposed substantially above said semi-floating dock structure, each one of said gondola cars are so equipped so as to depend downwardly from said monorail track so as to be positioned vertically over said semi-floating dock structure, and so as to be positioned substantially adjacent to at least one of said riverboats, whereby as each one of said gondola cars is positioned adjacent to at least one of said riverboats, and as said set of lateral locking guide means is actuated, passengers are transferred between said gondola car and said riverboat.

3. A Passenger Transfer Facility apparatus as recited in claim 1 wherein said means for leveling includes a plurality of support columns, each one of said support columns includes a plurality of inflatable members, each one of said inflatable members includes at least one verti-stop element, each one of said verti-stop elements arrayed substantially in a circular array about a centerline of said support columns, each one of said verti-stop elements extends vertically from the upper reaches of said support column downwardly, along said support column to a point of termination below said semi-floating dock structure, as each one of said inflatable members is actuated, each one of said inflatable members expands so as to bias each one of said verti-stop elements against a surface of said semi-floating dock structure, whereby said semi-floating dock structure is locked vertically, preventing said semi-floating dock structure from rising upward or depending downwardly into the water.

4. A Passenger Transfer Facility apparatus as recited in claim 3 wherein said means for leveling includes a control means for selectively actuating each one of said verti-stop elements whereby said semi-floating dock structure is leveled at one end and then is sequencially leveled at the other end.

5. A Passenger Transfer Facility apparatus as recited in claim 1 wherein said set of lateral locking guides includes two parallel members, each parallel member substantially parallel to each one of said gondola car sides so as to receive a lower portion of said gondola car side as each one of said gondola cars are lowered into said set of lateral locking guides.

6. A Passenger Transfer Facility apparatus, comprising:

a semi-floating dock structure, said semi-floating dock structure including at least one enclave docking element, said semi-floating dock structure including a means for leveling of said semi-floating dock structure, at least two riverboats, a primary riverboat and a secondary riverboat, each one of said riverboats including at least one enclave docking element that is disposed to a passenger compartment of each one of the riverboats, each one of said riverboats, primary and secondary, include at least one centermount element, each centermount element disposed to said passenger compartment of each one of said primary and said secondary riverboats, each one of said enclave docking elements receives one centermount element so as to mate with each one of said centermount elements, a clamping means, said clamping means disposed to the outer reaches of each one of said enclave docking elements, as said primary riverboat centermount element is mated with at least one of said enclave docking elements disposed to said semi-floating dock structure, said secondary riverboat centermount element is disposed within said primary riverboat enclave element where said primary riverboat is docked at said semi-floating dock structure and said secondary riverboat is docked at said primary riverboat.

7. A Passenger Transfer Facility apparatus, comprising:

a means for ferrying passengers, a semi-floating dock structure, said semi-floating dock structure including a means for leveling, at least two riverboats, a primary and a secondary riverboats with each one of said riverboats including at least one enclave docking element, each one of said riverboats including at least one centermount element, each one of said riverboats includes a means for shelter disposed to the lateral reaches of each one of said passenger compartments, each one of said riverboats includes a passenger compartment whereby as said means for ferrying passengers is disposed between said primary riverboat and said secondary riverboat, and as said means for shelter are actuated, said means for ferrying passengers is secured between said primary riverboat and said secondary riverboat and passengers thereupon transfer between said means for ferrying passengers and said primary riverboat and said secondary riverboat.

8. A Passenger Transfer Facility apparatus as recited in claim 7 wherein each one of said primary riverboat and said secondary riverboat include a means for shelter, a means for ferrying passengers, said means for ferrying passengers disposed substantially between said primary riverboat and said secondary riverboat so that, as said means for shelter is actuated, said means for ferrying passengers is biased between said primary riverboat and said secondary riverboat.

* * * * *